US010604891B2

(12) United States Patent
Keh

(10) Patent No.: US 10,604,891 B2
(45) Date of Patent: Mar. 31, 2020

(54) REACTIVE DYE BATH AND DYEING PROCESS FOR TEXTILES

(71) Applicant: The Hong Kong Research Institute of Textiles and Apparel Limited, Kowloon (HK)

(72) Inventor: Yee Man Edwin Keh, Kowloon (HK)

(73) Assignee: The Hong Kong Research Institute of Textiles and Apparel Limited, Kowloon (HK)

( * ) Notice: Subject to any disclaimer, the term of this patent is extended or adjusted under 35 U.S.C. 154(b) by 0 days.

(21) Appl. No.: 16/078,649

(22) PCT Filed: Mar. 8, 2016

(86) PCT No.: PCT/CN2016/075832
§ 371 (c)(1),
(2) Date: Aug. 22, 2018

(87) PCT Pub. No.: WO2017/147942
PCT Pub. Date: Sep. 8, 2017

(65) Prior Publication Data

US 2019/0048522 A1 Feb. 14, 2019

(30) Foreign Application Priority Data

Mar. 2, 2016 (CN) ..... 2016 1 0118947

(51) Int. Cl.
*D06P 1/00* (2006.01)
*D06P 1/38* (2006.01)
(Continued)

(52) U.S. Cl.
CPC ..... *D06P 1/38* (2013.01); *D06P 1/0032* (2013.01); *D06P 1/90* (2013.01); *D06P 1/928* (2013.01);
(Continued)

(58) Field of Classification Search
CPC ..... D06P 1/38; D06P 3/10; D06P 3/66; D06P 3/248; D06P 3/148; D06P 3/8252;
(Continued)

(56) References Cited

U.S. PATENT DOCUMENTS 4,500,321 A * 2/1985 Hugelshofer ..... C09B 67/0073 8/527

FOREIGN PATENT DOCUMENTS

CN 103203192 A 7/2013
CN 103485198 A 1/2014
(Continued)

OTHER PUBLICATIONS

Wan, Wei et al., "Study on the Reactive Dyeing in D5 Reverse Micelle System", Journal of Zhejiang Sci-Tech University, vol. 27, No. 5, Sep. 10, 2010 (Sep. 10, 2010), ISSN: 1673-3851, chapter 1.2.
(Continued)

*Primary Examiner* — Eisa B Elhilo
(74) *Attorney, Agent, or Firm* — Barlow Josephs and Holmes Ltd; Stephen Holmes

(57) ABSTRACT

The present invention relates to a reactive dye bath and a dyeing process for textiles. The reactive dye bath for textiles comprises an organic solvent, an aqueous dye solution, a surfactant and a co-surfactant. The reactive dye bath or the dyeing process of the present invention allows for full up-take of the dye without subjecting the textiles to any special pre-treatment and without the addition of a salt for accelerating dyeing, so as to obtain dyed textiles with a higher dyeing depth, uniformity and fastness.

9 Claims, 1 Drawing Sheet

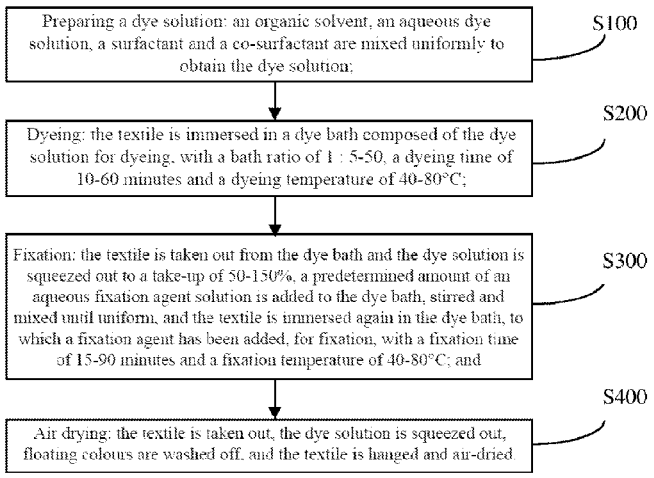

(51) Int. Cl.

| | |
|---|---|
| ***D06P 3/66*** | (2006.01) |
| ***D06P 1/90*** | (2006.01) |
| ***D06P 1/92*** | (2006.01) |
| ***D06P 3/14*** | (2006.01) |
| ***D06P 3/24*** | (2006.01) |
| ***D06P 5/00*** | (2006.01) |

(52) U.S. Cl.
CPC ..... *D06P 3/148* (2013.01); *D06P 3/248* (2013.01); *D06P 3/66* (2013.01); *D06P 3/666* (2013.01); *D06P 5/002* (2013.01)

(58) Field of Classification Search
CPC ..... D06P 1/0016; D06P 3/008; D06P 3/00; D06P 1/94; D06P 1/922; D06P 3/028; D06P 1/125; D06P 3/82; D06P 3/528; D06P 1/00; D06P 1/81; D06P 1/928; D06P 1/90
See application file for complete search history.

(56) References Cited

FOREIGN PATENT DOCUMENTS

| | | | |
|---|---|---|---|
| CN | 103964531 | A | 8/2014 |
| CN | 104313919 | A | 1/2015 |
| CN | 104313919 | A | 1/2015 |
| CN | 105442359 | A | 3/2016 |
| GB | 1315843 | A | 5/1973 |
| JP | 2004076190 | A | 3/2004 |

OTHER PUBLICATIONS

Li, Yanling et al, "Application Progress of Reverse Micelle Technique in Dyeing and Finishing Process", Dyeing and Finishing, No. 11, Jun. 1, 2014 (Jun. 1, 2014), ISSN: 1000-4017, Chapter 2.1, Table 1.
EPO Search Report for EP16892133.6, dated Sep. 20, 2019.

* cited by examiner

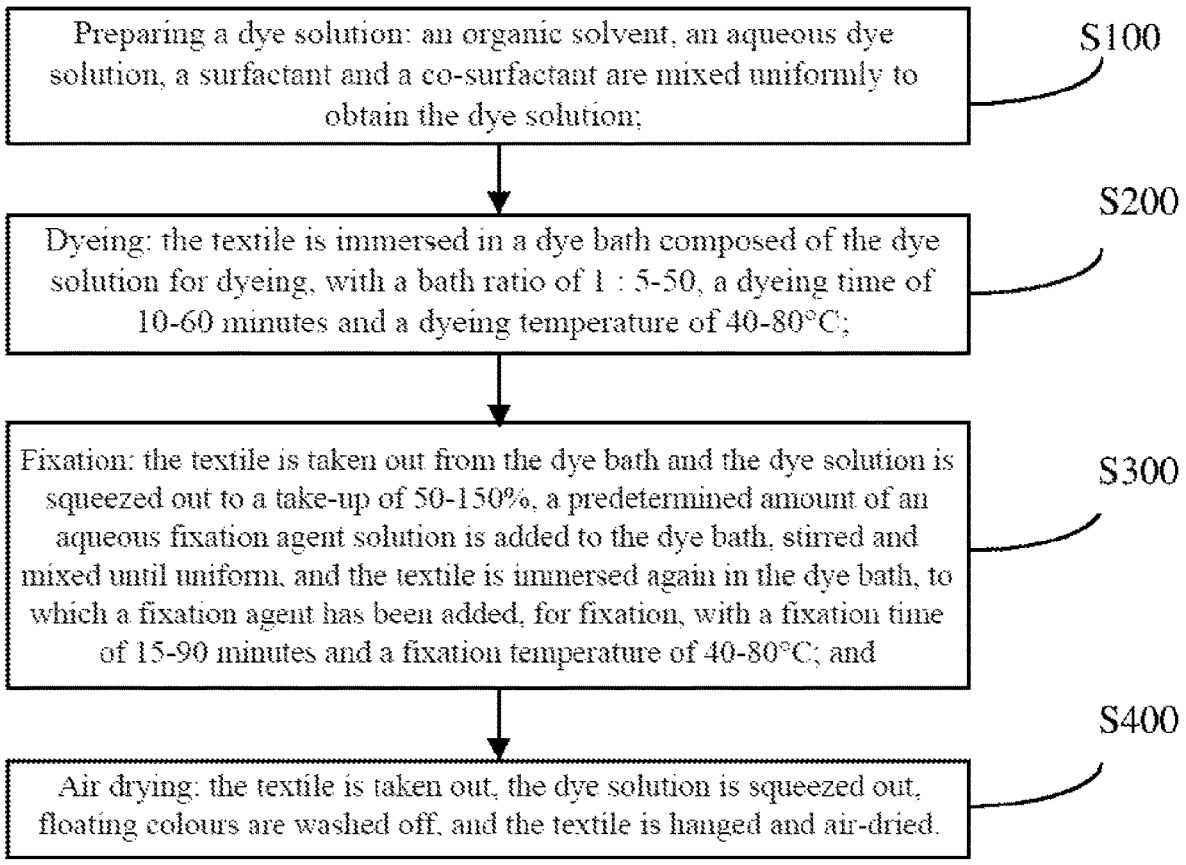
Preparing a dye solution: an organic solvent, an aqueous dye solution, a surfactant and a co-surfactant are mixed uniformly to obtain the dye solution;
S100
Dyeing: the textile is immersed in a dye bath composed of the dye solution for dyeing, with a bath ratio of 1 : 5-50, a dyeing time of 10-60 minutes and a dyeing temperature of 40-80°C;
S200
Fixation: the textile is taken out from the dye bath and the dye solution is squeezed out to a take-up of 50-150%, a predetermined amount of an aqueous fixation agent solution is added to the dye bath, stirred and mixed until uniform, and the textile is immersed again in the dye bath, to which a fixation agent has been added, for fixation, with a fixation time of 15-90 minutes and a fixation temperature of 40-80°C; and
S300
Air drying: the textile is taken out, the dye solution is squeezed out, floating colours are washed off, and the textile is hanged and air-dried.
S400

REACTIVE DYE BATH AND DYEING PROCESS FOR TEXTILES

TECHNICAL FIELD

The present invention belongs to the technical field of textile dyeing and finishing, and relates to a solvent assisted dyeing process for textiles, more specifically, to a reactive dye bath and a dyeing process using the reactive dye bath.

BACKGROUND ART

Water is generally used as a medium in traditional dyeing processes using reactive dyes for textiles. In addition to a waste problem caused by the hydrolysis of reactive dyes, a high water consumption and the discharge of highly polluted wastewater containing dyes and various auxiliaries also cause an increasingly serious impact on the environment. Particularly in recent years, with an increasing emphasis on environmental issues, workers in the textile industry are also increasingly committed to the development of new dyeing and finishing processes that are environmentally friendly and water-saving. In this context, solvent assisted dyeing processes using reactive dyes have been further developed.

The topic of using an organic solvent instead of water as a textile dyeing and finishing medium has been studied by textile workers for several decades. The easy separation and recovery characteristics of organic solvents can effectively reduce the discharge of polluted wastewater. Particularly in recent years, some documents have reported replacing water with a low toxicity or non-toxic organic solvent as a main dyeing medium for reactive dyes, which can greatly reduce the water consumption in the dyeing process while resulting in a dyeing depth that is similar to that of traditional water bath dyeing; moreover, the dyeing can be done at a lower temperature without the addition of any salt for accelerating dyeing; and after the dyeing is complete, most of the organic solvent is recycled and it will not be directly discharged to the environment. It can be seen that this is a very energy-saving and environmentally friendly dyeing process.

The main principle of this process for dyeing with a reactive dye using an organic solvent that replaces part of the water medium (i.e., a solvent assisted dyeing method) is based on the use of the reverse micelle theory. Reverse micelles are nanoscale spherical aggregates that are self-assembled from water, an oil and a surfactant at a specific ratio under certain conditions. There is a stable aqueous microenvironment, i.e., so-called water-pool, in the interior region of the micelle. Under certain conditions, some hydrophilic substances such as enzymes can be solubilized in the water-pool without losing their activities. Likewise, hydrophilic dyes, such as reactive dyes, can also be solubilized in the water-pool of the reverse micelle to form a reverse micelle-reactive dye dyeing system with an organic solvent as the main medium. In this dyeing system, textiles can achieve similar dyeing effects to the effect of an all-water bath dyeing system.

However, due to the dyeing mechanism, the reactive dye often undergoes a fixation reaction under basic conditions so as to achieve a good colour fastness. In some documents regarding studies on solvent assisted dyeing processes using reactive dyes, a process involving pre-padding with an aqueous sodium carbonate solution and then placing a sodium carbonate-containing textile into a reverse micelle-reactive dye dyeing system for dyeing is described. Although in this method two steps of dyeing and fixing can be performed in one step, the problems of reduced levelness, reduced fixation rate, dye wasting, etc., can still be caused due to the hydrolysis of the reactive dye in a basic aqueous environment.

In other studies, textiles are pretreated with cationic modifiers, followed by solvent assisted dyeing using reactive dyes. This method can significantly improve the textile dyeing performance and increase the utilization of the dyes. However, since the cationic modifiers are used for treating the textiles, water is still required as a medium, leading to the discharge of a large amount of waste water; some cationic modifiers have higher costs and may have adverse effects on the environment; if the cation modification treatment process is improper, and the modifier does not penetrate into the interior of fibres, a phenomenon of ring dyeing of the textile may also be caused, affecting the colour brightness and colour fastness of the textile.

Therefore, under the premise of ensuring a dyeing depth, uniformity and colour fastness, minimizing the waste of hydrolysis of the reactive dye in the solvent-assisted dyeing process and to avoid a special pretreatment that is water consumptive and has a potential negative impact on the environment has become a problem that needs to be solved in solvent assisted dyeing processes.

SUMMARY OF THE INVENTION

In order to solve the above-mentioned problems, the present invention provides a reactive dye bath and a dyeing process for textiles, which has a low water consumption.

The technical solution of the present invention to solve the above-mentioned technical problems is a reactive dye bath, which comprises of a dye emulsion composed of an organic solvent, an aqueous dye solution, a surfactant and a co-surfactant.

In the reactive dye bath as provided by the present invention, the organic solvent is a non-polar organic solvent, the non-polar organic solvent is hydrophobic and can form an immiscible emulsion with water; and this kind of organic solvents comprises C6-C8 alkanes, C6-C8 isoalkanes, perchloroethylene, decamethylcyclopentasiloxane (D5), dibutyl acetal (e.g., Solvon K4), glycol ethers, and high flash point hydrocarbons.

In the reactive dye bath as provided by the present invention, said aqueous dye solution is an aqueous solution formed of a DyStar Levafix CA series reactive dye in water, with the mass ratio of the reactive dye to water being 1:10-200; and the volume ratio of said aqueous dye solution to said organic solvent is 1:1-20.

In the reactive dye bath as provided by the present invention, said surfactant is a non-ionic or cationic surfactant; and the volume ratio of said surfactant to said organic solvent is 1:5-20.

In the reactive dye bath as provided by the present invention, said co-surfactant is an alcohol substance that can change the surface activity and the hydrophilicity-lipophilicity balance of the surfactant; the co-surfactant comprises ethanol, n-propanol, isopropanol, n-butanol, isobutanol, n-pentanol, isopentanol, 1-hexanol, 2-hexanol, 1-octanol, 2-octanol, and fusel oil; and the volume ratio of said co-surfactant to said organic solvent is 1:5-20.

The present invention further provides a process for dyeing a textile, the process comprising the following steps:

S100. Preparing a dye bath: an organic solvent, an aqueous dye solution, a surfactant and a co-surfactant are mixed uniformly to obtain the dye bath;

S200. Dyeing: the textile is immersed in the dye bath, with a bath ratio of 1:5-50, a dyeing time of 10-60 minutes and a dyeing temperature of 40-80° C.;

S300. Fixation: the textile is taken out from the dye bath and squeezed to remove the dye emulsion until a take-up of 50-150%, a predetermined amount of an aqueous fixation agent solution is added to the dye bath, stirred and mixed until uniform, and the textile is immersed again in the dye bath, to which a fixation agent has been added, with a fixation time of 15-90 minutes and a fixation temperature of 40-80° C.; and S400. Air drying: the textile is taken out, the dye emulsion is squeezed out, floating colours are washed off, and the textile is hanged and air-dried.

In step S300 of the process for dyeing a textile as provided by the present invention, said aqueous fixation agent solution is an aqueous solution of sodium carbonate or sodium bicarbonate, with the mass ratio of the fixation agent to water being 1:5-100; and the volume ratio of said aqueous fixation agent solution to said dye solution is 1:1-20.

The process for dyeing a textile as provided by the present invention further comprises, after step S400, S500. Solvent recovery: the organic solvent is recovered from the dye solution, using methods including a distillation method, a thin membrane filtration method, and a centrifugation method.

In the process for dyeing a textile as provided by the present invention, said textile is loose fibres, yarns and a fabric composed of at least one of cellulosic fibres, protein fibres, and chemical synthetic fibres, wherein said cellulose fibres comprise cotton, hemp, and regenerated cellulose fibres, said protein fibres comprise wool, silkworm silk, and regenerated protein fibres, and said chemical synthetic fibres comprise chinlon 6 and chinlon 66.

In the process for dyeing a textile as provided by the present invention, said textile contains at least one reactive group of hydroxy, amino and carboxy groups, and the textile can be dyed directly without any special pretreatment.

Implementing the present invention results in the following beneficial effects: the present invention allows for full up-take of the dye without subjecting the textile to any special pretreatment and without the addition of a salt for accelerating dyeing, so as to obtain a dyed textile with a higher dyeing depth, uniformity and fastness.

BRIEF DESCRIPTION OF THE DRAWINGS

In order to more clearly illustrate the technical solutions in the embodiments of the present invention or in the prior art, the drawings used in the description of the embodiments or the prior art will be briefly described below; obviously, the drawings in the following description are merely for some embodiments of the present invention, and a person of ordinary skill in the art would also be able to obtain other drawings according to these drawings without involving any inventive effort.

FIG. 1 is a flow chart of the process for dyeing a textile in the present invention.

DETAILED DESCRIPTION OF EMBODIMENTS

The technical solutions in the embodiments of the present invention will be clearly and completely described below in conjunction with examples.

The present invention provides a reactive dye bath for textiles, composed of an organic solvent, an aqueous dye solution, a surfactant and a co-surfactant. Applicable textiles comprise loose fibres, yarns and fabrics composed of fibres containing groups such as active hydroxy (—OH), amino (—NH2) and carboxy (—OOH), e.g., cellulosic fibres (e.g., cotton, hemp, and regenerated cellulosic fibres), protein fibres (e.g., wool, silkworm silk, and regenerated protein fibres), and chemical synthetic fibres (e.g., chinlon 6 and chinlon 66). The textile can be directly dyed without any special pretreatment and also without additionally adding an inorganic salt for accelerating dyeing during dyeing.

Preferably, the organic solvent used in the present invention is a non-polar organic solvent which is hydrophobic in nature and can form an immiscible emulsion with water; and the organic solvent comprises C6-C8 alkanes, C6-C8 isoalkanes, perchloroethylene, decamethylcyclopentasiloxane (D5), dibutyl acetal (e.g., Solvon K4), glycol ethers, and high flash point hydrocarbons.

Preferably, the aqueous dye solution used in the present invention is an aqueous solution formed of a DyStar Levafix CA series reactive dye in water, with the mass ratio of the reactive dye to water being 1:10-200; and the volume ratio of the aqueous dye solution to the organic solvent is 1:1-20. The formation of an emulsion from the aqueous dye solution and the organic solvent is carried out by dispersing the aqueous reactive dye solution in the organic solvent medium. A predetermined amount of the aqueous reactive dye solution is added to the organic solvent, and under the combined action of the surfactant and the co-surfactant, the aqueous reactive dye solution is stably dispersed in the organic solvent to form an emulsion, i.e., the dye bath. Preferably, the surfactant used is a non-ionic or cationic surfactant, e.g., a polyethylene glycol-type surfactant; and the volume ratio of the surfactant to the organic solvent is 1:5-20.

Preferably, the co-surfactant used in the present invention is an alcohol substance that can change the surface activity and the hydrophilicity-lipophilicity balance of the surfactant; the co-surfactant comprises ethanol, n-propanol, isopropanol, n-butanol, isobutanol, n-pentanol, isopentanol, 1-hexanol, 2-hexanol, 1-octanol, 2-octanol, and fusel oil; and the volume ratio of the co-surfactant to the organic solvent is 1:5-20.

FIG. 1 shows a flow chart of the process for dyeing a textile in the present invention, and shows a method for using the reactive dye bath of the present invention. The specific examples are as follows.

Example 1

The process for dyeing a textile as provided in this example comprises the following steps:

1. Preparing dye bath: an organic solvent, an aqueous dye solution, a surfactant and a co-surfactant are mixed uniformly, placed in a dyeing cup, sealed and intensely stirred to form a uniform emulsion, followed by obtaining a dye emulsion, and forming a dye bath, wherein the mass ratio of the reactive dye to water is 1:15, the volume ratio of the aqueous dye solution to the organic solvent is 1:10, the volume ratio of the surfactant to the organic solvent is 1:10, and the volume ratio of the co-surfactant to the organic solvent is 1:10; and the organic solvent is Solvon K4, the dye is DyStar Levafix CA red dye, the surfactant is tridecyl polyoxyethylene(12) ether, and the co-surfactant is 1-octanol;

2. Dyeing: 10 g of a knitted pure cotton semi-bleached cloth is immersed and dyed in the dye bath with the bath ratio (the ratio of the mass of the substance to be dyed to the volume of the dye solution, the same below) being 1:15, and after being sealed, the dyeing cup is placed in an oscillating water bath with a dyeing time of 30 minutes and a dyeing temperature of 60° C.;

3. Fixation: the textile is taken out from the dye bath and squeezed to remove the dye emulsion until a take-up of 100%, a predetermined amount of an aqueous fixation agent solution is added to the dye bath, stirred and mixed until uniform to form an emulsion, the textile is immersed again in the dye bath, to which a fixation agent has been added, for fixation, and the dyeing cup is placed in an oscillating water bath with a fixation time of 60 minutes and a fixation temperature of 60° C., wherein the aqueous fixation agent solution is an aqueous solution of sodium carbonate, with the mass ratio of the fixation agent to water being 1:20; and the volume ratio of the aqueous fixation agent solution to the dye solution is 1:10.

4. Air drying: the textile is taken out, the dye emulsion is squeezed out, and the textile is washed in a soap liquid to wash off floating colours, hanged and air-dried.

5. Solvent recovery: the organic solvent is recovered from the dye emulsion by a centrifugation method.

Comparative experiment of traditional water bath dyeing: where the organic solvent is replaced with 150 ml of a 1% aqueous solution of sodium chloride, no surfactant and co-surfactant are added and the other process parameters are unchanged, a pure water bath dyed cotton fabric sample is obtained as a comparative. From a visual inspection, there is no significant difference in surface colour uniformity between the cotton fabrics dyed under the two process conditions.

Table 1 lists the test results of the surface colour depths (K/S value) and the colour fastnesses of the fabrics under the two process conditions, and shows that the fabric resulting from the solvent-assisted dyeing has a higher surface colour depth under the condition of having a similar colour fastness to the cotton fabric resulting from the pure water bath dyeing.

TABLE 1

Performance test results of the cotton fabrics resulting from the dye bath dyeing process in the present invention and from the pure water bath dyeing process

| Test item | Cotton fabric resulting from dye bath dyeing in the present invention | Cotton fabric resulting from solvent assisted dyeing |
|---|---|---|
| K/S value | 255 | 429 |
| Colour fastness to dry rubbing | 4.5 | 4.5 |
| Colour fastness to wet rubbing | 2.5 | 2.0 |
| Colour fastness to water washing | 4.5 | 4.5 |
| Colour fastness to sweat staining | 4.5 | 4.5 |
| Colour fastness to sunlight | 4.5 | 4 |

Example 2

The process for dyeing a textile as provided in this example comprises the following steps:

1. Preparing dye bath: an organic solvent, an aqueous dye solution, a surfactant and a co-surfactant are mixed uniformly, placed in a dyeing cup, sealed and intensely stirred to form a uniform emulsion, followed by obtaining a dye emulsion, and forming a dye bath, wherein the mass ratio of the reactive dye to water is 1:200, the volume ratio of the aqueous dye solution to the organic solvent is 1:1, the volume ratio of the surfactant to the organic solvent is 1:5, and the volume ratio of the co-surfactant to the organic solvent is 1:5; and the organic solvent is D5, the dye is DyStar Levafix CA blue dye, the surfactant is polyethylene glycol, and the co-surfactant is 2-hexanol;

2. Dyeing: 10 g of a wool serge fabric is immersed and dyed in the dye bath with the bath ratio being 1:5, and after being sealed, the dyeing cup is placed in an oscillating water bath with a dyeing time of 60 minutes and a dyeing temperature of 40° C.;

3. Fixation: the textile is taken out from the dye bath and squeezed to remove the dye emulsion until a take-up of 150%, a predetermined amount of an aqueous fixation agent solution is added to the dye bath, stirred and mixed until uniform to form an emulsion, the textile is immersed again in the dye bath, to which a fixation agent has been added, for fixation, and the dyeing cup is placed in an oscillating water bath with a fixation time of 15 minutes and a fixation temperature of 80° C., wherein the aqueous fixation agent solution is an aqueous solution of sodium bicarbonate, with the mass ratio of the fixation agent to water being 1:5; and the volume ratio of the aqueous fixation agent solution to the dye solution is 1:20.

4. Air drying: the textile is taken out, the dye emulsion is squeezed out, and the textile is washed in a soap liquid to wash off floating colours, hanged and air-dried.

5. Solvent recovery: the organic solvent is recovered from the dye emulsion by a distillation method.

Comparative experiment of traditional water bath dyeing: where the organic solvent is replaced with 150 ml of a 1% aqueous solution of sodium chloride, no surfactant and co-surfactant are added and the other process parameters are unchanged, a pure water bath dyed cotton fabric sample is obtained as a comparative. From a visual inspection, there is no significant difference in surface colour uniformity between the cotton fabrics dyed under the two process conditions.

Example 3

The process for dyeing a textile as provided in this example comprises the following steps:

1. Preparing dye bath: an organic solvent, an aqueous dye solution, a surfactant and a co-surfactant are mixed uniformly, placed in a dyeing cup, sealed and intensely stirred to form a uniform emulsion, followed by obtaining a dye emulsion, and forming a dye bath, wherein the mass ratio of the reactive dye to water is 1:10, the volume ratio of the aqueous dye solution to the organic solvent is 1:20, the volume ratio of the surfactant to the organic solvent is 1:20, and the volume ratio of the co-surfactant to the organic solvent is 1:20; and the organic solvent is a glycol ether, the dye is DyStar Levafix CA yellow dye, the surfactant is tridecyl polyoxyethylene(12) ether, and the co-surfactant is isopentanol;

2. Dyeing: 10 g of chinlon is immersed and dyed in the dye bath with the bath ratio being 1:50, and after being sealed, the dyeing cup is placed in an oscillating water bath with a dyeing time of 10 minutes and a dyeing temperature of 80° C.;

3. Fixation: the textile is taken out from the dye bath and squeezed to remove the dye emulsion until a take-up of 50%, a predetermined amount of an aqueous fixation agent solution is added to the dye bath, stirred and mixed until uniform to form an emulsion, the textile is immersed again in the dye bath, to which a fixation agent has been added, for fixation, and the dyeing cup is placed in an oscillating water bath with a fixation time of 90 minutes and a fixation temperature of 40° C., wherein the aqueous fixation agent solution is an aqueous solution of sodium carbonate, with the mass ratio of the fixation agent to water being 1:100; and the volume ratio of the aqueous fixation agent solution to the dye solution is 1:1.

4. Air drying: the textile is taken out, the dye emulsion is squeezed out, and the textile is washed in a soap liquid to wash off floating colours, hanged and air-dried.

5. Solvent recovery: the organic solvent is recovered from the dye solution by a thin membrane filtration method.

Comparative experiment of traditional water bath dyeing: where the organic solvent is replaced with 150 ml of a 1% aqueous solution of sodium chloride, no surfactant and co-surfactant are added and the other process parameters are unchanged, a pure water bath dyed cotton fabric sample is obtained as a comparative. From a visual inspection, there is no significant difference in surface colour uniformity between the cotton fabrics dyed under the two process conditions.

It should be understood that the above technical solutions are only used to illustrate the present invention but are not used to limit the scope of the present invention. In addition, after reading the contents of the present invention, a person skilled in the art would be able to change or modify the present invention, and the equivalent forms are also within the scope defined by the appended claims of the present application.

The invention claimed is:

1. A reactive dye bath for textiles, characterized in that the reactive dye bath comprises a dye emulsion comprising an organic solvent, an aqueous reactive dye solution, a surfactant and a co-surfactant, wherein said aqueous reactive dye solution has a mass ratio of the reactive dye to water is 1:10-200, and wherein the volume ratio of said aqueous reactive dye solution to said organic solvent is 1:1-20.

2. The reactive dye bath for textiles according to claim 1, wherein the organic solvent is a non-polar organic hydrophobic solvent which can form an immiscible emulsion with water; and wherein the non-polar organic hydrophobic solvent comprises C6-C8 alkanes, C6-C8 isoalkanes, perchloroethylene, decamethylcyclopentasiloxane, dibutyl acetal, glycol ethers, and high flash point hydrocarbons.

3. The reactive dye bath for textiles according to claim 1, wherein said surfactant is a non-ionic or cationic surfactant; and the volume ratio of said surfactant to said organic solvent is 1:5-20.

4. The reactive dye bath for textiles according to claim 1, wherein said co-surfactant is an alcohol substance that can change the surface activity and the hydrophilicity-lipophilicity balance of the surfactant; wherein the co-surfactant comprises ethanol, n-propanol, isopropanol, n-butanol, isobutanol, n-pentanol, isopentanol, 1-hexanol, 2-hexanol, 1-octanol, 2-octanol, and fusel oil; and wherein the volume ratio of said co-surfactant to said organic solvent is 1:5-20.

5. A process for dyeing a textile, characterized in that the process comprises the following steps:

(i) preparing a dye bath by uniformly mixing an organic solvent, an aqueous dye solution, a surfactant and a co-surfactant;

(ii) immersing the textile in the dye bath with a bath ratio of 1:5-50, a dyeing time of 10-60 minutes and a dyeing temperature of 40-80° C.;

(iii) removing the textile from the dye bath and squeezing the textile to remove the dye solution until a take-up of 50-150%;

(iv) adding a predetermined amount of an aqueous fixation agent solution to the dye bath, and stirring and mixing the aqueous fixation agent solution and the dye solution until uniform;

(v) re-immersing the textile in the dye bath, to which the aqueous fixation agent solution has been added, with a fixation time of 15-90 minutes and a fixation temperature of 40-80° C.; and (vi) removing the textile from the dye bath, squeezing the dye solution out of the textile; washing floating colours out of the textile, and hanging and air-drying the textile.

6. The process for dyeing a textile according to claim 5, wherein said aqueous fixation agent solution is an aqueous solution of sodium carbonate or sodium bicarbonate, with the mass ratio of the fixation agent to water being 1:5-100; and wherein the volume ratio of said aqueous fixation agent solution to said dye solution is 1:1-20.

7. The process for dyeing a textile according to claim 5, wherein the process further comprises recovering the organic solvent from the dye solution using methods selected from the group including distillation method, thin membrane filtration, and centrifugation.

8. The process for dyeing a textile according to claim 5, wherein said textile is loose fibres, yarns and a fabric composed of at least one of cellulosic fibres, protein fibres, and chemical synthetic fibres, wherein said cellulose fibres comprise cotton, hemp, and regenerated cellulose fibres, wherein said protein fibres comprise wool, silkworm silk, and regenerated protein fibres, and wherein said chemical synthetic fibres comprise chinlon 6 and chinlon 66.

9. The process for dyeing a textile according to claim 8, wherein said textile contains at least one reactive group of hydroxy, amino and carboxy groups, and the textile can be dyed directly without any special pre-treatment.

* * * * *